US005988985A

United States Patent [19]

Steinrück

[11] Patent Number: 5,988,985

[45] Date of Patent: Nov. 23, 1999

[54] METHOD AND APPARATUS FOR CONTROLLING COMPRESSOR VALVES IN A PISTON COMPRESSOR

[75] Inventor: Peter Steinrück, Vienna, Austria

[73] Assignee: Hoerbiger Ventilwerke Aktiengesellschaft, Vienna, Austria

[21] Appl. No.: 08/851,934

[22] Filed: May 6, 1997

[30] Foreign Application Priority Data

Apr. 12, 1996 [AT] Austria ..... 662/96

[51] Int. Cl.[6] ..... F04B 19/22

[52] U.S. Cl. ..... 417/53; 417/218

[58] Field of Search ..... 417/53, 218, 212

[56] References Cited

U.S. PATENT DOCUMENTS 4,325,677 4/1982 Nonnenmacher ..... 417/218
4,892,465 1/1990 Born et al. ..... 417/218
4,976,106 12/1990 Noerskau et al. ..... 60/452
5,533,867 7/1996 Strenzke ..... 417/53
5,588,805 12/1996 Geringer ..... 417/53
5,622,478 4/1997 Elliott et al. ..... 417/53

*Primary Examiner*—Charles G. Freay
*Assistant Examiner*—Robert Z. Evora
*Attorney, Agent, or Firm*—Watson Cole Grindle Watson, PLLC

[57] ABSTRACT

A method and apparatus for reducing the loading impact between a sealing element in a suction valve of a piston compressor with a valve stop, wherein the sealing element is forcibly opened using a control device shortly before attaining pressure balance between cylinder and suction chambers of the compressor.

16 Claims, 5 Drawing Sheets

METHOD AND APPARATUS FOR CONTROLLING COMPRESSOR VALVES IN A PISTON COMPRESSOR

BACKGROUND OF THE INVENTION

1. Field of the Invention

The present invention generally relates to compressor valves in a piston compressor. In particular, the invention relates to a method and apparatus for controlling the movement of a sealing element of a suction valve within a piston compressor by means of a control device.

2. Description of the Conventional Art

The useful life of an automatic compressor valve used mostly on the suction and pressure side is influenced primarily by the impact loading during the alternating impacting of an actual sealing element on a valve seat and/or valve stop. In particular, the sealing element is in a closed position when the pressure inside a cylinder chamber is greater than or equal to the counter-pressure of a suction chamber. When the counter-pressure of the suction chamber exceeds the falling pressure of the cylinder chamber (i.e., underpressure in the cylinder chamber), the sealing element is forced into an open position. Due to the rapid underpressure produced in the cylinder chamber, the sealing element, when moving toward an open position, accelerates at high speed in the direction of the valve stop. This rapid acceleration creates an undesirable loading impact on the sealing element which in turn adversely diminishes the useful life of the compressor valve.

In the case of a suction valve, by corresponding choice of the spring system, the closing speed can be kept sufficiently low to reduce the closing impact. For instance, to reduce the opening impact, a system of so-called double damping is used, which, after overcoming part of a stroke, the sealing element impacts on a damping plate or the like, movable in the direction of opening, is thereby braked and then, together with the damping plate, overcomes the remaining stroke, whereby the clearly enlarged moving mass causes a further decrease in the acceleration of the sealing element, resulting in a clearly reduced impact speed of the sealing element at the valve stop, compared with the simple valve of this kind.

Furthermore, compressor arrangements have become known in which, with the aid of so-called lift lugs (unloaders), on the one hand a capacity adjustment, continuously variable within certain limits, is brought about by partial holding open of the suction valve during the compression stroke, and in which, on the other hand, by corresponding dimensioning of the mass of the lift lug as well as the arrangement of motion damper, a lowering of the impact speed of the sealing element during closing is achieved.

To some extent the aforementioned arrangements also can be used to reduce the impact speed of the sealing element during opening: the lift lug is pressed by means of a spring against the sealing element or valve plate and, in any case, is already sitting there for a while before the pressure balance is attained. The additional opening force caused by this pressure spring may also open the sealing element under certain circumstances already before the pressure balance is attained. In this regard, however, the mass of the lift lug must be accelerated by the spring force against the overpressure in the cylinder chamber. Since the mass of such lift lugs is necessarily relatively great compared with the mass of the sealing elements used, in any case only a slight acceleration results and the premature opening of the sealing element caused by this under certain circumstances is minor.

SUMMARY OF THE INVENTION

It is, therefore, an object of the present invention to avoid the above-mentioned problems by providing a method and device for controlling the compressor valve to minimize the loading impact of a sealing element on a valve stop by means of a control device.

The invention starts with the knowledge that with usual valve arrangements when the pressure balance is attained between the cylinder chamber and the suction chamber, the sealing element of the valve is closed under the action of its spring system. In this way, the expansion of the gas enclosed in the cylinder continues at an unreduced speed, whereby in quick sequence a high underpressure is produced in the cylinder chamber, which, as of a certain value and overcoming the spring-system and inertia of the sealing element, results in a powerful instantaneous acceleration of the sealing element in the direction of the valve stop.

According to a first exemplary embodiment of the invention, there is provided a method and apparatus for controlling movement of a sealing element of a suction valve in a piston compressor comprising the step of acting on the sealing element by means of a control device having a hydraulic control cylinder such that shortly before a pressure balance is attained between cylinder and suction chambers of the compressor, the sealing element is opened by the control device.

In particular, the opening of the sealing element, which preferably takes place in a crank angle ranging from 0° to 20° before attaining a pressure balance between the cylinder and suction chambers of the compressor. The sealing element is thereby lifted shortly before the pressure balance is attained, whereby the under-suction otherwise characteristic for automatic valves of the kind described is avoided in the indicator diagram. Since the sealing element of the suction valve, for example a one-piece or multiple-part valve plate, has been already opened when the pressure balance is attained, a pressure compensation can occur between the cylinder volume and the suction chamber, whereby the decompression phase in the cylinder is ended. The resulting maximum underpressure in the cylinder chamber is henceforth determined by the throttling loss of the already opened valve and is substantially less than in the aforementioned conventional case. The differential pressure causing a further opening of the sealing element of the suction valve is clearly decreased, resulting in an essentially low acceleration and/or impact speed of the sealing element at the valve stop.

The crank angle or time of the impact, as well as the mass relationship and the relative speed of the impact partners are chosen in such a way that after the impact, the opening speed of the sealing element up to the stop at the valve stop does not decrease to zero and preferably does not drop below 10% of the speed that occurs immediately before the impact. In this way, it is ensured that the prematurely initiated opening motion of the sealing element is not brought to a halt again or reversed as a result of too little initial impetus under the action of the spring system of the sealing element and/or of the overpressure still effective in the cylinder, because then, for the subsequent, purely pressure-dependent opening of the sealing element, the disadvantages, described in the beginning, of the conventional arrangements or methods would again hold true.

In accordance with a second exemplary embodiment of the invention, the pressure causing the periodic opening of the sealing element is monitored by a hydraulic control component of the control cylinder and used to indirectly determine the opening speed of the sealing element.

In accordance with a third exemplary embodiment of the invention, the volume flow of a hydraulic medium is monitored by measuring the pressure drop at a throttle inserted in the feed connected to the control component, and is used to indirectly determine the opening speed of the sealing element.

In accordance with a fourth exemplary embodiment of the invention, the crank angle or the point in time of the force opening of the sealing element is chosen such that the intensity of the opening impact is minimized, which is determined by means of a measuring sensor which monitors vibration in the valve area.

In accordance with a fifth exemplary embodiment of the invention, the course of the indicator pressure in the cylinder chamber is monitored and the time of the opening of the sealing element is selected such that the under-suction peak in the indicator diagram is minimized.

Other features and advantages of the invention will become apparent upon reference to the following Description of the Exemplary Embodiments when read in light of the attached drawings.

DESCRIPTION OF THE EXEMPLARY EMBODIMENTS

Figure 1:
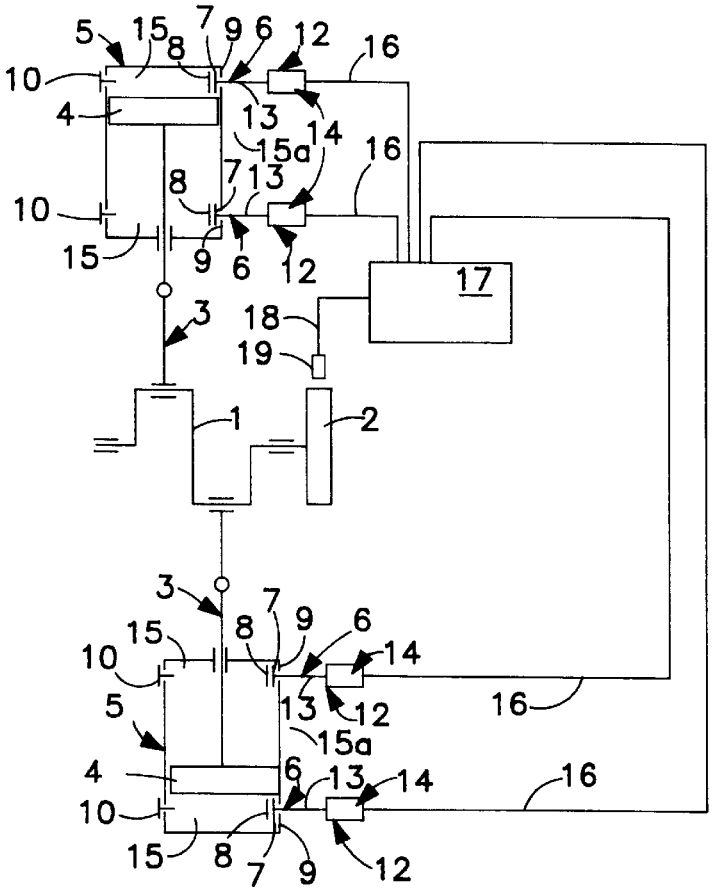
FIG. 1 is a schematic diagram of a piston compressor according to a first exemplary embodiment of the invention.

The piston compressor according to FIG. 1 has a crank shaft 1 which is flange-mounted onto a flywheel 2. The crank shaft 1 actuates pistons 4 within double-acting cylinders 5 via connecting rods 3. Through the oscillating motion of the pistons 4, gas enters the cylinders 5 through suction valves 6 when sealing elements 7 of the suction valves 6 move toward valve stops 8 and away from valve seats 9 (i.e., in an open position). The gas in the cylinders 5 may be compressed after the sealing elements 7 in the cylinders 5 move toward the valve seats 9 and away from the valve stops 8 (i.e., in a closed position), or the gas is pushed out of the cylinders 5 via the pressure valves 10.

The opening movement of the sealing elements 7 of the suction valves 6 is controlled by means of control devices 12 acting on the sealing elements 7 when necessary at least over part of the crank circular path. These control devices 12 have lift lugs 13 that forcibly open the sealing elements 7 via hydraulic control cylinders 14 just shortly before a pressure balance is attained between the cylinder chambers 15 and the compressor's suction chambers 15*a* situated outside of the suction valves 6. In addition to the control cylinders 14, the control devices 12 further comprise electronic drives (not shown) which are coordinated by means of bus connections 16, thereby allowing information to be exchanged between the control devices 12 and an evaluating unit 17. Additionally, a signal is fed from a signal indicator 19 to the evaluating unit 17 via line 18. With this signal, the movement of the sealing elements 7 can be synchronized with the oscillating movement of the pistons 4.

In more detail, the opening of the sealing elements 7, which preferably takes place in a crank angle ranging from 0° to 20° before attaining a pressure balance between the cylinder chambers 15 and the suction chambers 15*a*, is initiated by impacting the sealing elements 7 with the control devices 12. In particular, the crank angle or time of the impact, as well as the mass relationship and the relative speed of the impact partners, are chosen such that after the impact, the opening speed of the sealing elements 7 does not decrease to zero or preferably does not drop below 10% of the speed that occurs immediately before the impact. In this way, it is ensured that the prematurely initiated opening motions of the sealing elements 7 are not brought to a halt again or reversed as a result of too little initial impetus under the action of the spring system of the sealing elements 7 and/or of the over-pressure still effective in the cylinder chambers 15.

Figure 2:
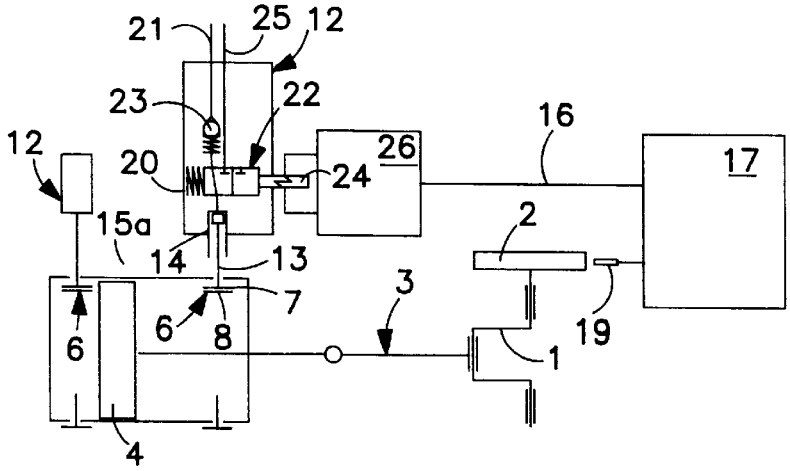
FIG. 2 is a detailed schematic diagram showing a portion of the piston compressor of FIG. 1.

In FIG. 2, one of the control devices 12 shown in FIG. 1 is illustrated in greater detail. The lift lug 13, which acts on one of the sealing elements 7 of the suction valves 6, is actuated by a hydraulic control cylinder 14 containing hydraulic fluid which is fed from a hydraulic feed line 21. The feed line 21 is connected to the control cylinder 14 via a control component 22, preferably a ⅔-port directional control valve 20. When gas inside the cylinder chamber 15 is compressed by the piston 4, the compressed gas does not force the suction valve 6 to move into a closed position because a check valve 23 in the feed line 21 prevents hydraulic fluid confined in the control cylinder 14 from flowing back into the feed line 21.

On the other hand, if current is applied to a coil 24 connected to the control component 22 during the changeover of the control valve 20 so that the hydraulic cylinder 6 is connected to hydraulic discharge line 25, closing movement of the suction valve 6 is initiated. An electronic circuit (not shown) arranged in a housing 26 applies current to the coil 24 and determines the timely actuation of the control valve 20. The corresponding actuation times are established by synchronous pulses sent to the electronics via the bus connection 16, and by parameters such as the time interval expressed in degrees of crank angle (° CA) communicated via the bus connection 16. For each control device 12, angles of the crank circular path of the flywheel 2 are determined by an evaluating unit 17 such that by supplying power to the coil 24, the control valve 20 is driven on (KWon) or off (Kwoff).

Figure 3:
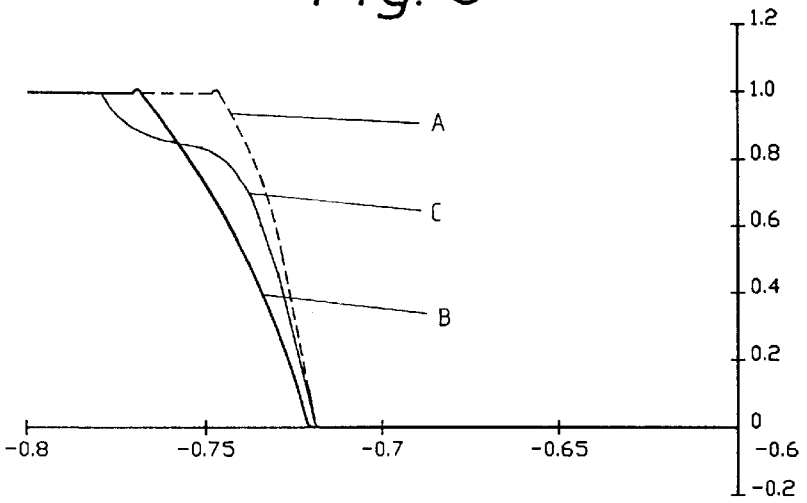
FIG. 3 is a chart showing progress in time of a stroke of a suction valve in the piston compressor of FIG. 1.

FIG. 3 shows a chart of the opening movement of one of the sealing elements 7 of the suction valve 6 which is driven according to the first exemplary embodiment of the invention. In particular, a vertical stroke is applied over a dimensionless proportional time as a relative stroke in relation to the total stroke of the compressor piston. The time scale is chosen such that when one complete piston stroke is made, the dimensionless time is defined by numeral 1, and when the lower end point of movement is reached, the dimensionless time is defined by numeral 0.

Figure 4:
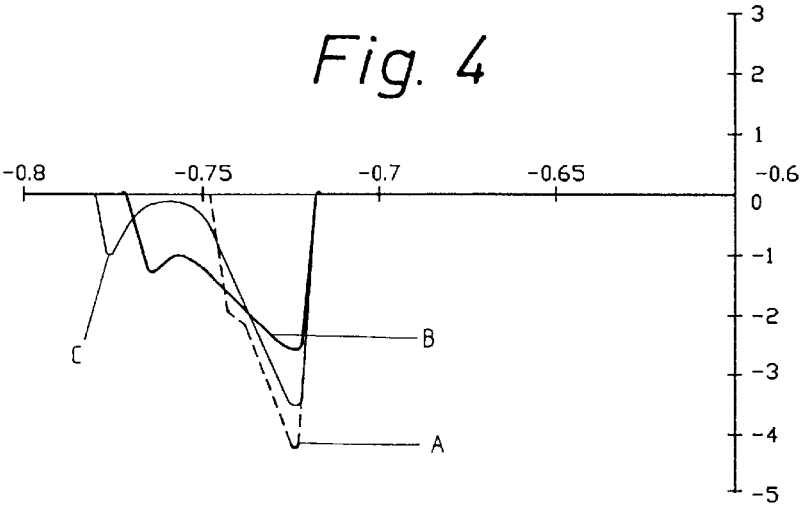
FIG. 4 is a chart showing progress in time of the opening speed of the suction valve of FIG. 3.

FIG. 4 shows a chart of the speed of one of the sealing elements 7 over the dimensionless proportional time, whereby a suitable time scale according to FIG. 3 was chosen.

Figure 5:
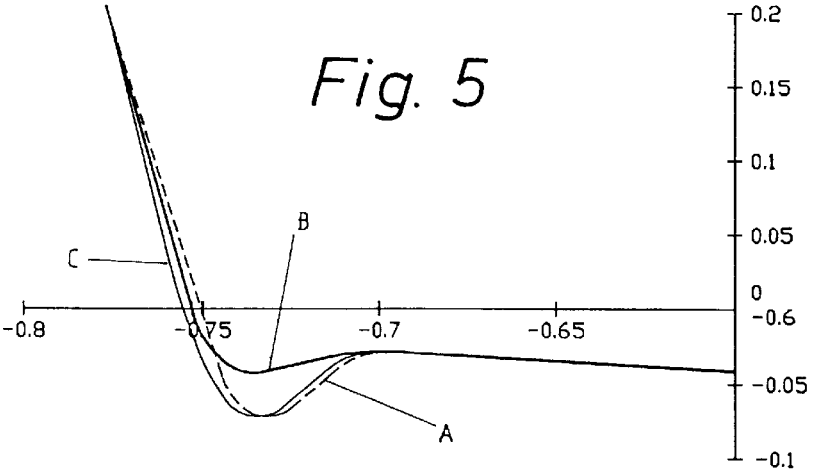
FIG. 5 is a chart showing progress in time of the pressure in a cylinder chamber of the piston compressor of FIG. 1.

In FIG. 5, the pressure in one of the cylinder chambers 15 is shown. More specifically, FIG. 5 illustrates the progress in time of the pressure in the cylinder chamber 15 just before and after a pressure balance between the cylinder chamber 15 and the suction chamber 15*a* is attained.

In FIGS. 3, 4, and 5, the curves marked by letter A represent the case in which the lift lug 13 is delivered too late. The sealing element 7 opens exclusively under the action of the differential pressure between the cylinder chamber 15 and the suction chamber 15*a* of the compressor 1. The quick drop in cylinder pressure after the pressure balance is crossed causes an acceleration of the sealing element 7. The resulting high speed of the sealing element 7 creates a forceful and undesired opening impact against the valve stop 8. In certain situations, the sealing element 7 may also rebound due to the spring system and come to rest in the open position after one or more impacts.

The curves marked by letter B represent the opening progression for a delivery time of the lift lug 13 optimized according to the first exemplary embodiment of invention. The sealing element 7 of the suction valve 6 is pressed open just before the pressure balance is attained. As a result of the action of the lug impact, when the pressure balance is attained between the cylinder chamber 15 and the suction chamber 15*a*, the suction valve 6 is already opened to a good extent. In this way, the filling of the cylinder chamber 15 with gas can begin immediately after the pressure balance is attained.

If, on the other hand, the lift lug 13 is delivered too early according to the curves marked by letter C, the over-pressure still present in the cylinder chamber 15 quickly brakes the initiated opening movement of the suction valve 6 and the system of the lift lug 13 plus sealing element 7 comes to a halt again. Only when the opening force and the differential pressure counterbalance each other can the opening movement start again. Since the sealing element 7 is opened slightly when the pressure balance is attained, the cylinder pressure quickly drops and a strong under-suction occurs. For this reason, considerable opening forces act on the sealing element 7 causing it to hit the valve stop 8 at high speed.

Figure 6:
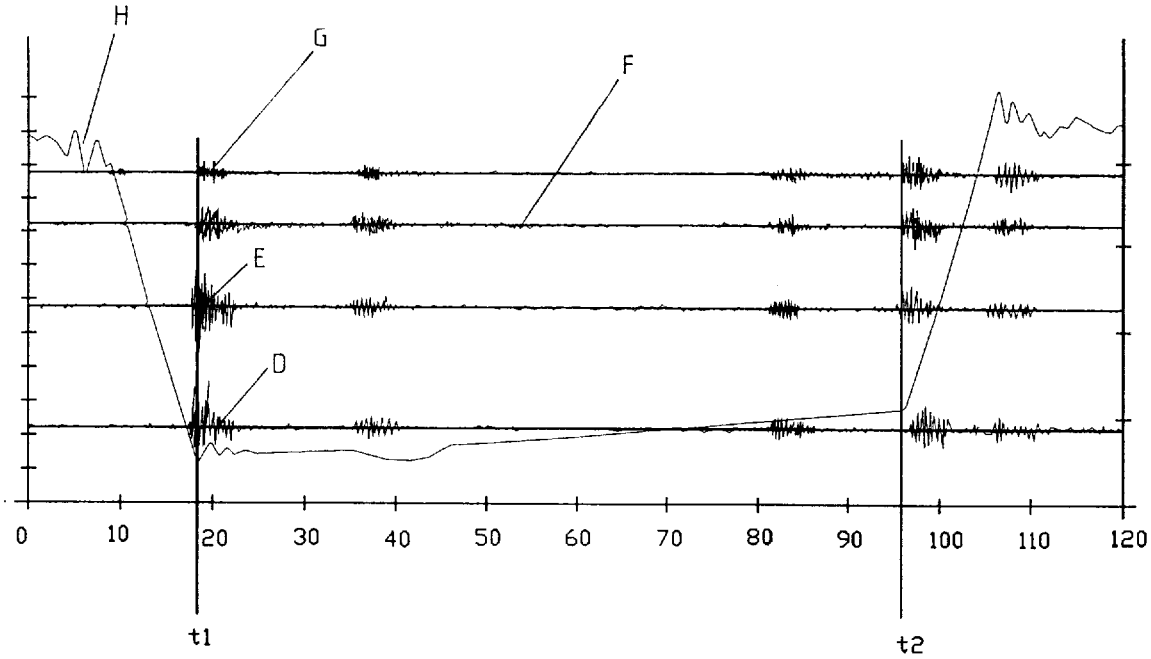
FIG. 6 is a chart showing intensities of the vibration signals when crank angles are varied in time according to an exemplary embodiment of the invention.

FIG. 6 shows the influence of the time of delivery of the lift lug 13 as shown in FIGS. 1 and 2. Over the period in ms, the vibrations or accelerations measured at the valve stop 8 are applied for various points in time or crank angles of the delivery of the lift lug 13. The curve marked by letter D corresponds to KWon=13°, letter E corresponds to KWon=11°, letter F corresponds to KWon=9°, and letter G correspond to KWon=7°. Also shown in FIG. 6 is the program in time of the indicator pressure (cylinder interior)—the corresponding curve is marked by letter H.

At the point in time $t_1$, the opening impact of the suction valve 6 in the form of a quickly fading pulse-stimulated vibration. The closing of the suction valve 6 is indicated by the vibrations occurring as of the point in time $t_2$. Curve D shows the vibration signal for a lug delivery time chosen clearly too late. In the case of the other curves E, F and G, the delivery time or crank angle of the lift lug 13 shown in FIGS. 1 and 2 is advanced in each case by 2° KW.

Figure 7:
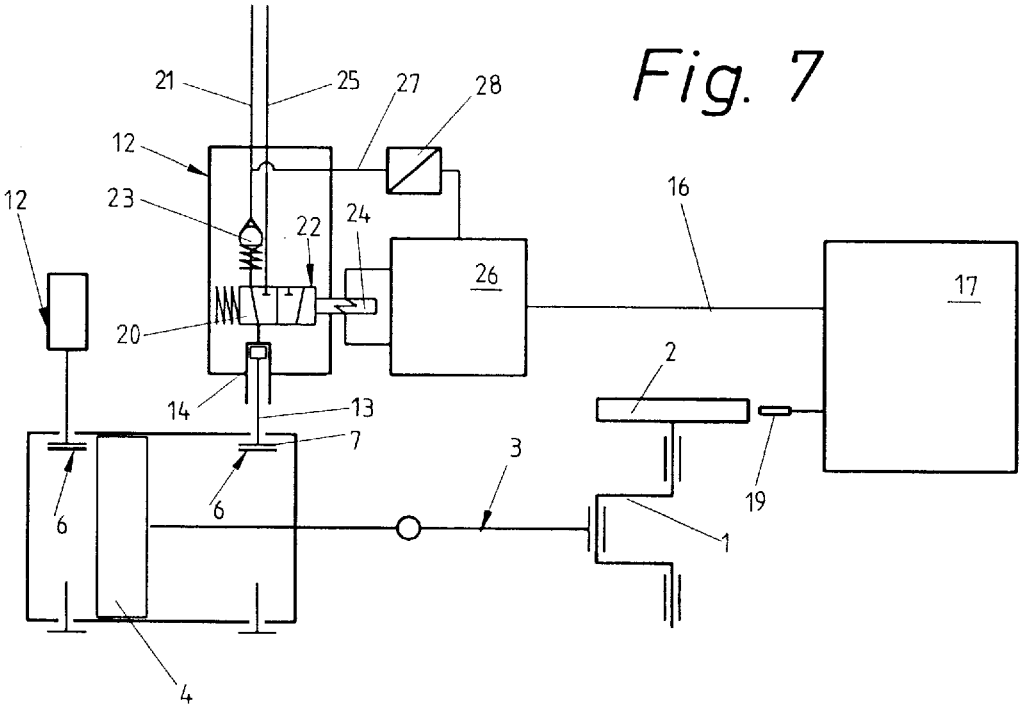
FIG. 7 is a schematic diagram of a piston compressor according to a second exemplary embodiment of the invention.

FIG. 7 shows a second exemplary embodiment of the invention which indirectly determines the opening speed of the sealing element 7 by means of monitoring the hydraulic medium pressure that causes the periodic opening of the sealing element 7. In this connection, a measuring sensor 28 connected via signal line 27 to the feed line 21 is used, and its measuring signals are evaluated by an electronic circuit (not shown) arranged in the housing 26.

In FIG. 7, the sealing element 7 has an electrically switching 2/3-port directional control valve 20 whose drive electronics (not shown) are connected with an evaluating unit 17 which is furthermore connected with at least one measuring sensor 28 to monitor the opening motion of the sealing element 7. The control device 12 or the aforementioned lift lug 13 is hydraulically actuated, whereby the delivery movement is preferably initiated via an electrically switching, fast directional control valve 20. The time of the beginning of the delivery movement is determined by the change-over of this directional control valve 20 and can be predetermined by a suitable system with presetting, for example of the change-over crank angle, or by a control system that determines the optimal point in time.

The hydraulic pressure is measured at the aforementioned 2/3-port directional control valve 20. In this connection, before the control valve 20 is opened, essentially the system pressure in the feed line 21 is measured at a measuring point. The subsequent opening of the control valve 20 causes a dilution wave that spreads out in the feed line 21 at the speed of sound. A steep drop to ambient pressure will occur at the measuring point. As soon as the reflections of the dilution wave arrive at the measuring point, the pressure fluctuates maximally between the system pressure and the ambient pressure. During the then progressing movement of the lift lug 7, the pressure pulsations fade away. The frequency of these pulsations is determined by the distance of the 2/3-port directional control valve 20 from the nearest hydropneumatic pulsation damper (not shown) or other compensating reservoir arranged in the feed line.

Moreover, as soon as the delivered control device 12 is braked, the delay of the hydraulic medium column still flowing causes an upstream running compression wave, that is observed as steep rise in the pressure at the measuring point. The pressure recorded at the measuring point fluctuates as of this point in time by a clearly greater value than before. If the control device 12 reaches the sealing element 7 and stops on it because the delivery time was chosen too early and when the sealing element 7 is reached by the control device 12 there is still an excessively high cylinder chamber pressure, then the described pressure increase occurs or can be observed.

As soon as the pressure in the cylinder chamber 15 has reached the suction pressure, the sealing element 7 and the control device 12 then start moving again together, which can be observed by a repeated decrease in the hydraulic medium pressure. If the control device 12 along with the sealing element 7 reaches the stroke end position defined by the valve stop 8, then a rapid pressure rise would allow the condition to be ascertained at the measuring point.

If the change-over of the control component or 2/3-port directional control valve 20 takes place at the optimal time, the control device 12 or lift lug 13 can immediately impact on the sealing element 7 or the valve stop 8. Only after the end position determined by the valve stop 8 does the sealing element 7 along with the control device 12 remain at rest, whereby the above-described pressure rise at the measuring point occurs only once during a work-cycle of the compressor 1.

If the change-over of the control component 12 or 2/3-port directional control valve 20 takes place too late, the control device 12 is likewise stopped only when reaching the end position determined by the valve stop 8. The result is, as optimal change-over time of the control component 12 or 2/3-port directional control valve 20, the earliest time at which the aforementioned steep pressure rise is observed only once per work-cycle of the compressor 1. This is also true if the sealing element 7 rebounds after reaching the end position and collides with the still moving control device 12. The relationship of mass of the control device 12 to mass of the sealing element 7 in this case causes only a slight braking of the control device 12 and no notable compression wave.

Figure 8:
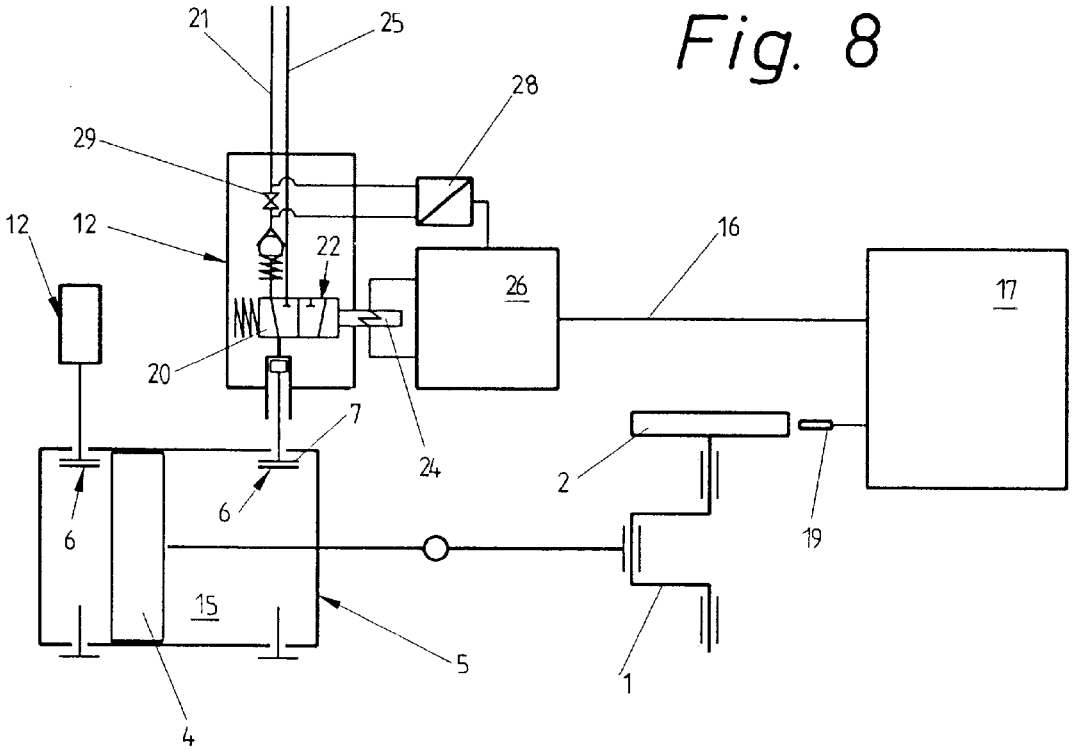
FIG. 8 is a schematic diagram of a piston compressor according to a third exemplary embodiment of the invention.

In FIG. 8, for the indirect monitoring of the opening speed of the sealing element 7, a measuring or monitoring of the pressure drop is carried out at a throttle 29 inserted in the feed line 21 to the control component 22, by means of a measuring sensor 28 recording the differential pressure in front of and behind the throttle 29.

In more detail, to determine the actually relevant course of movement of the sealing element 7 opened prematurely according to the invention, the momentary pressure decrease at a throttle inserted in the feed line 21 to the control component 12 is monitored. This throttle 29 should be sized as to result in a measurable decrease in the medium pressure behind the throttle 29 at the expected speeds. If the movement of the control device 12 or of a lift lug 13 then begins, the differential pressure measured at the throttle 29 also increases. If the control device 12 reaches the sealing element 7 and stops on it because the delivery time was chosen too early and when the sealing element 7 is reached by the control device 12 there is still an excessively high cylinder chamber pressure, then the differential pressure observed at the throttle 29 reaches a minimum. Only when the pressure in the cylinder chamber 15 drops further does the movement of the control device 12 resume in turn, after which a rise in the differential pressure can in turn be observed at the throttle 29. An optimal setting is provided in this case when the earliest possible delivery time is set at which the described minimum of the differential pressure at the throttle 29 can no longer be observed as a result of a complete braking of the lift lug 13 at the valve stop 8 or of the control device 12 at the sealing element 7.

Figure 9:
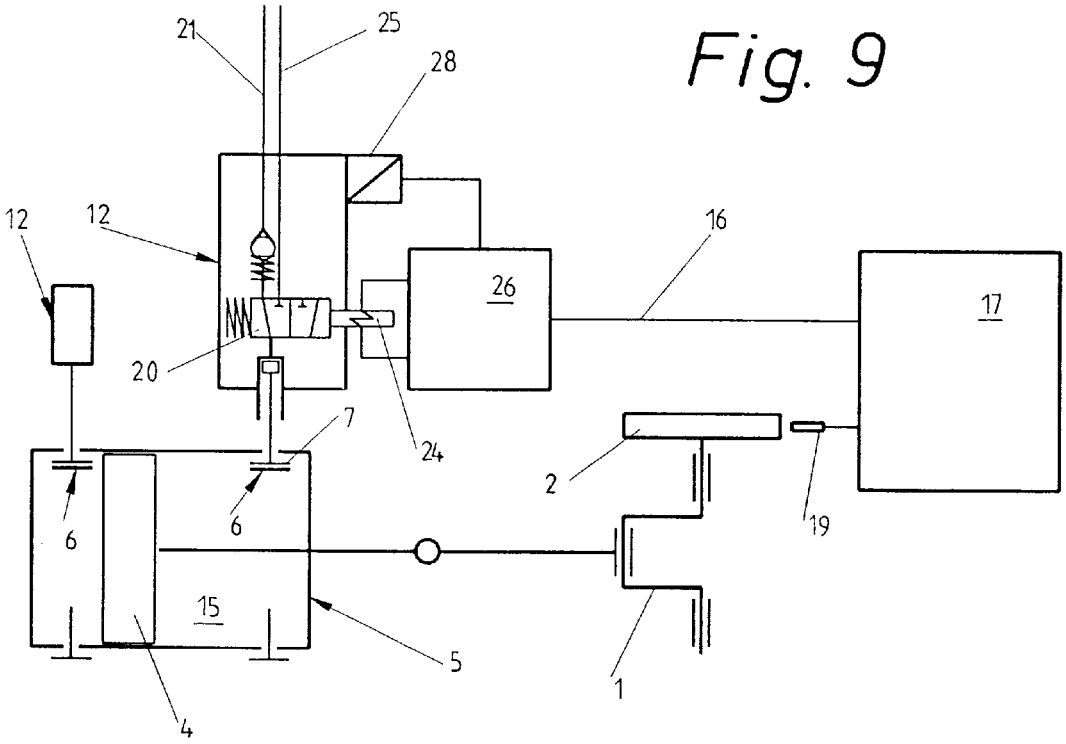
FIG. 9 is a schematic diagram of a piston compressor according to a fourth exemplary embodiment of the invention.

In FIG. 9, the point in time of the forced opening of the sealing element 7 is chosen in such a way that the intensity of the opening impact determined by means of the measuring sensor 28 via a vibration monitoring in the valve area is minimized. The measuring sensor 28 acting as acceleration sensor, aside from the mounting at the control device 12, could also be mounted immediately at the cylinder 5 at a suitable place, for example in the immediate vicinity of the suction valve 6. Signals of the measuring sensor 28 are in turn evaluated in the circuit electronics arranged in the housing 26 in a manner not shown, and are used to determine the initiation of the procedure of opening the sealing element 7.

The crank angle or time of opening of the sealing element 7 is chosen in such a way that the intensity of the opening impact determined via a vibration monitoring in the valve area is minimized. The opening impact of suction valve 6 causes a pulse-like stimulation of the natural vibrations of the valve stop 8. These structure-borne vibrations quickly fade away within a characteristic period of time. The intensity of the opening impact is then quantified in the described manner by measuring the accelerations in the direction of the valve axle in the time window after the valve opening until after the end of the period characteristic for the fading behavior. These detectable accelerations are usually in very high frequency ranges. For this reason, the intensity of the vibrations deduced from the recording of the generating curve of the envelope of the vibrations or, in particularly simple manner, of the course of amplitude by low-pass filtering of the rectified-vibration signal, can be used for assessing the opening impact. In this way, the optimal delivery time of the control device or of a lift lug, or the like can be determined in an advantageous manner directly by minimizing the intensity of the vibrations caused by the opening impact of the suction valve 6.

Figure 10:
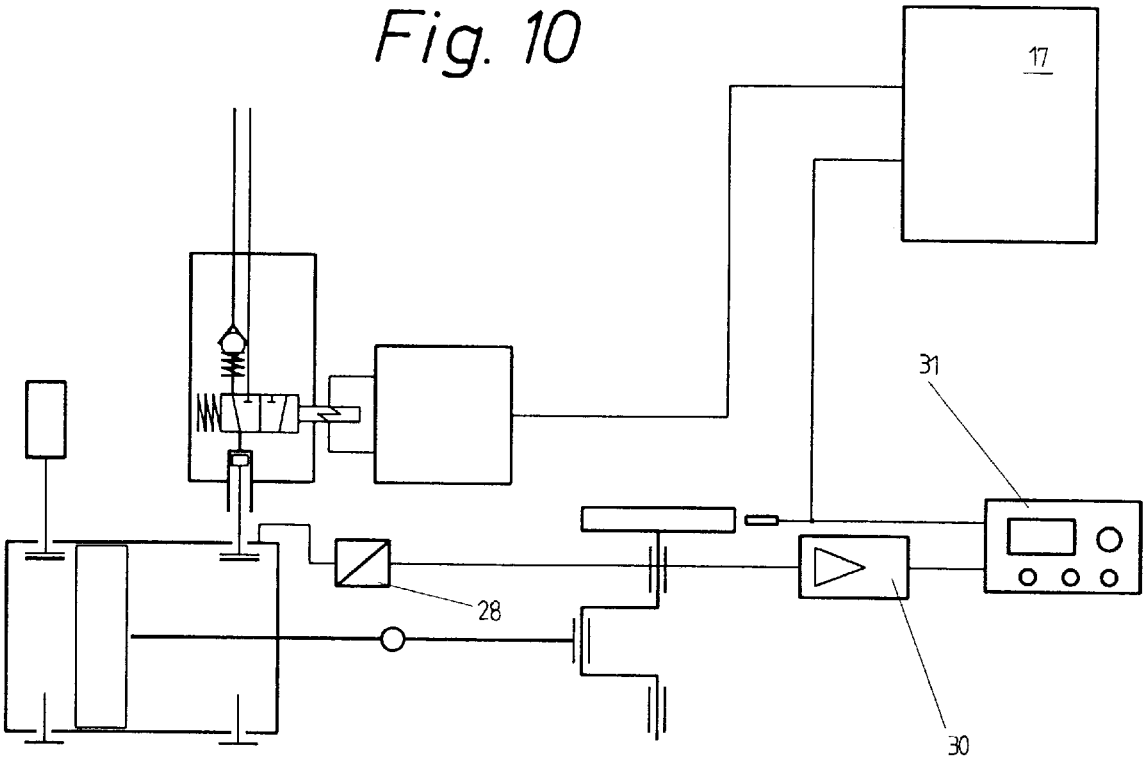
FIG. 10 is a schematic diagram of the piston compressor of according to a fifth exemplary embodiment of the invention.

According to FIG. 10, the time of initiation of the opening of the sealing element 7 is chosen in such a way that the under-suction peak in the indicator diagram is minimized. The indicator pressure is measured in this case by means of the measuring sensor 28 designed as pressure recorder and whose signal is amplified via a measuring amplifier 30 and, with the aid of a suitable display device 31, is represented as indicator diagram over the piston stroke or, as an alternative, is displayed as time signal. By means of the evaluating unit 17, the time of the opening of the sealing element 7 can in turn also be chosen here in such a way that in the aforementioned manner, the under-suction peak in the indicator diagram is minimized. Alternatively, a representation of the pressure over the crank angle or over the time can be used instead of the indicator diagram.

Insofar as they are the same or comparable at least with respect to function, identical reference numbers were used for identical parts in FIGS. 1, 2 and 7–10. To avoid repetitions, as regards the function of individual components not discussed later, the forms of execution for FIGS. 1 and 2 are referred to.

While particular exemplary embodiments of the present invention have been shown and described, it will be apparent to those skilled in the art that various changes and modifications may be made therein without departing from the spirit or scope of the invention. Accordingly, it is intended that the appended claims cover such changes and modifications that come within the spirit and scope of the invention.

What is claimed is:

1. In a piston compressor assembly which includes a gas cylinder, a gas piston movable therein and a suction valve attached to said gas cylinder to control flow of gas into a chamber formed in said gas cylinder from an external suction chamber based on location and movement of said gas piston in said gas cylinder, said suction valve including a valve seat, a stop and a sealing member movable between said valve seat and said stop to open or close said suction valve, the improvement wherein a control apparatus is cooperable with said sealing member to move said sealing member away from said valve seat to open said suction valve prior to said valve member being opened by suction created in said chamber by movement of said gas piston, said control apparatus comprising a hydraulic cylinder containing a reciprocatingly movable hydraulic piston that is connected to a lift lug which can contact said valve member when positioned on said valve seat, a hydraulic pressure medium supply means, a control device for controlling whether hydraulic medium is supplied from said hydraulic pressure medium supply means to said hydraulic cylinder to move said hydraulic piston and thus said lift lug in a first direction against said valve member to open said suction valve, or removed from said hydraulic cylinder to enable said piston and thus said lift lug to move in a direction opposite said first direction, an evaluating unit connected to said control device to control operation thereof, and detector means for sensing location and movement of said gas piston in said gas cylinder, said detector means being connected to said evaluating unit.

2. A piston compressor assembly as defined in claim 1, including a rotatable crankshaft to which said gas piston is connected so as to move said gas piston in said gas cylinder, and a flywheel connected to said rotatable crankshaft, said wherein said detector means comprises a signal indicator adjacent said flywheel to determine rotational positioning of said crankshaft and thus location and movement of said gas piston in said gas cylinder.

3. A piston compressor assembly as defined in claim 1, wherein said control device includes a 2/3-port directional control valve.

4. A piston compressor assembly as defined in claim 3, wherein said control device includes electronic circuitry for operating said 2/3-port directional control valve.

5. A piston compressor assembly as defined in claim 4, wherein said hydraulic pressure medium supply means includes an inlet line with a one-way check valve.

6. A piston compressor assembly as defined in claim 5, including a measuring sensor connected to said inlet line to measure pressure of hydraulic medium therein and provide a measure of opening speed of said valve member.

7. A piston compressor assembly as defined in claim 4, including a hydraulic pressure medium discharge line for discharging hydraulic medium from said hydraulic cylinder based on positioning of said 2/3-port directional control valve.

8. A piston compressor assembly as defined in claim 5, including a throttle in said inlet line and a measuring sensor connected to said inlet line upstream and downstream of said throttle to measure pressure drop of said hydraulic medium across said throttle and provide a measure of opening speed of said valve member.

9. A control apparatus for controlling the movement of a sealing element between a seat and a stop of a suction valve operatively connected to a gas cylinder of a piston compressor, said control apparatus comprising a hydraulic cylinder which includes a hydraulic piston therein mounting a lift lug contacting said sealing element; a control device for regulating flow of hydraulic medium to and away from said hydraulic cylinder and control movement of said hydraulic piston, said control device including a 2/3 port directional control valve; an evaluating unit connected to control operation of said 2/3 port directional control valve, and means connected to said evaluating unit for determining the position of a gas piston reciprocatingly movable in said gas cylinder.

10. A method of controlling opening movement of a sealing element from a valve seat towards a stop in a suction valve connected to a chamber in a gas cylinder of a piston compressor assembly, said gas cylinder including a gas piston which reciprocatingly moves in said gas cylinder to alternatively pressurize said chamber and close said suction valve and then depressurize said chamber and open said suction valve and enable gas from an external suction chamber to flow therethrough into said cylinder chamber, said method comprising the steps of (a) sensing the positioning of the gas piston in said gas cylinder, and (b) pushing said sealing element off said valve seat and towards said stop prior to movement of said gas piston in said gas cylinder causing gas pressure in said cylinder chamber to decrease to equality with the gas pressure in said external suction chamber.

11. A method as defined in claim 10, wherein during closing of the suction valve the valve seat impacts the valve seat at a predetermined speed, and wherein in step (b) the sealing element is pushed away from said valve seat at a speed which is at least 10% of said predetermined speed.

12. A method as defined in claim 10, wherein said gas piston is connected to a rotating crankshaft with a flywheel, and wherein step (a) includes sensing the rotational positioning of said flywheel.

13. A method as defined in claim 12, including a control device having a hydraulic cylinder with a hydraulic piston movable therein, said hydraulic piston being connected to a lift lug, and wherein in step (b) said hydraulic piston is moved in said hydraulic cylinder to cause said lift lug to contact said valve member and move said valve member away from said valve seat and towards said stop.

14. A method as defined in claim 12, wherein step (b) occurs when angular rotation of said rotating crankshaft is sensed to be between 0 and 20° prior to a corresponding positioning of said gas piston in said gas cylinder wherein gas pressure in said cylinder chamber has decreased to equality with gas pressure in said suction chamber.

15. A method as defined in claim 10, including a step of monitoring gas pressure in said cylinder chamber and initiating step (b) to minimize monitored under-suction peaking in said cylinder chamber.

16. A method as defined in claim 10, including a step of monitoring vibration of said gas cylinder adjacent said suction valve and initiating step (b) to minimize said monitored vibration.

* * * * *